US006786379B2

(12) United States Patent
Largo

(10) Patent No.: US 6,786,379 B2
(45) Date of Patent: Sep. 7, 2004

(54) FASTENER DRIVING TOOL HAVING PRESSURIZED POWER SOURCE

(75) Inventor: Marc Largo, Gurnee, IL (US)

(73) Assignee: Ilinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/264,149

(22) Filed: Oct. 3, 2002

(65) Prior Publication Data

US 2003/0127238 A1 Jul. 10, 2003

Related U.S. Application Data

(60) Provisional application No. 60/345,430, filed on Jan. 4, 2002.

(51) Int. Cl.[7] ..... B25C 1/14
(52) U.S. Cl. ..... 227/10; 227/130; 123/46 SC
(58) Field of Search ..... 227/8, 10, 130, 227/156; 123/46 SC

(56) References Cited

U.S. PATENT DOCUMENTS

| | | | | |
|---|---|---|---|---|
| 3,049,712 A | | 8/1962 | Khan | |
| 3,362,602 A | * | 1/1968 | Anstett | 227/156 |
| 3,967,771 A | * | 7/1976 | Smith | 227/10 |
| 4,211,352 A | * | 7/1980 | Zilka | 227/130 |
| 5,329,685 A | | 7/1994 | Gillespie | |
| 5,339,517 A | * | 8/1994 | Diemer | 29/809 |
| 5,562,240 A | | 10/1996 | Campbell | |
| 6,220,496 B1 | * | 4/2001 | Hirai et al. | 227/130 |

FOREIGN PATENT DOCUMENTS

| | | |
|---|---|---|
| DE | 37 30 048 | 3/1989 |
| DE | 201 10 754 | 10/2001 |
| EP | 0 191 186 | 8/1986 |
| JP | 2001-001279 | 1/2001 |
| WO | 03/03867 A1 | 5/2003 |

* cited by examiner

*Primary Examiner*—Scott A. Smith
(74) *Attorney, Agent, or Firm*—Lisa M. Soltis; Mark W. Croll; Donald J. Boch

(57) ABSTRACT

A fastener driving tool is disclosed having a self contained pre-pressurized pneumatic power source. Operator actuation of a trigger mechanism causes a pressurized medium supplied by the self contained pre-pressurized power source to flow through a valve and to propel a piston connected to a driver blade towards a nosepiece assembly end of the tool. The flow of the pressurized medium through the valve further recoils a spring-biased activating bolt which resets the trigger mechanism.

17 Claims, 4 Drawing Sheets

FASTENER DRIVING TOOL HAVING PRESSURIZED POWER SOURCE

CROSS-REFERENCE TO RELATED APPLICATIONS

The present Application claims priority under Title 35 U.S.C. §119 on copending Provisional Patent Application Serial No. 60/345,430, filed Jan. 4, 2002.

BACKGROUND OF THE INVENTION

The present invention relates generally to fastener driving tools, and more specifically to such a tool having a pre-pressurized power delivery source.

Power tools for use in driving fasteners into workpieces are known in the art. Such tools can be operated by a variety of power sources, including pneumatic, combustion, electric or powder-activated power sources. In some power tools, the power source is integrated with a housing of the tool for easy portability. Other applications require power to be fed with a feed line from an external source, such as pneumatic tools operated by an air compressor.

Fastener driving tools of this type, and particularly pneumatically powered tools, include a gun-shaped metal housing and a magazine portion, which is attached to the housing and/or the handle. Generally, the magazine retains a supply of fasteners which are fed to a drive track in the housing adapted to receive a fastener and to guide the fastener as the fastener is driven from the drive track into a workpiece.

The housing also includes a piston in a main chamber of the fastener driving tool which is mounted for reciprocal movement along the chamber to be driven by compressed air, products of combustion, or otherwise from a retracted position to an extended position in a driving stroke. The driving stroke of the piston moves a driver blade in the drive track that impacts a fastener to drive the fastener into a workpiece. The piston is also configured to be oppositely driven by a return spring, a partial vacuum, or other known apparatus in a return stroke to the retracted position.

The use of existing fastener driving power tools has certain disadvantages. One disadvantage is that these tools are designed with a large number of components, any one of which can malfunction due to wear and tear in normal use. Additionally, costs for assembly, manufacture, and repair of these tools can be considerable. Another drawback associated with some existing fastener driving power tools is that they can be fatiguing to use on a continual basis due to their weight and bulkiness. Furthermore, some tools of this type require a power feed line, such as a compressed air hose, which is awkward to use since, in addition to the tool, the power feed line must be transported by the operator.

BRIEF SUMMARY OF THE INVENTION

A portable pneumatic power tool is disclosed having a magazine to sequentially supply fasteners to a nosepiece of the tool for impacting into a workpiece. The tool has a housing having a reciprocating driver blade at least partially positioned within the housing. The driver blade is driven by a self contained pre-pressurized power delivery source preferably located in a vessel that is removably attached to the housing.

In an alternative embodiment, a trigger mechanism is disclosed for a fastener driving tool having a pre-pressurized power source and a magazine for storing and sequentially urging fasteners toward a nosepiece through which a driver blade travels to impact and drive the fasteners into a workpiece. The trigger mechanism has a valve-opening member, a valve, and a trigger. The valve is capable of being opened and closed by reciprocation or the valve-opening member, and controls a flow of a pressurized medium from the pre-pressurized power source. The trigger holds the valve-opening member in a set position until being actuated, which causes the valve-opening member to move in a lateral direction to open the valve and permitting a flow of the pressurized medium through the valve. The flow of the pressurized medium through the valve is limited to a fixed amount by the flow, which causes the valve-opening member to recoil to the set position and reset the trigger mechanism.

DETAILED DESCRIPTION OF THE INVENTION

Figure 1:
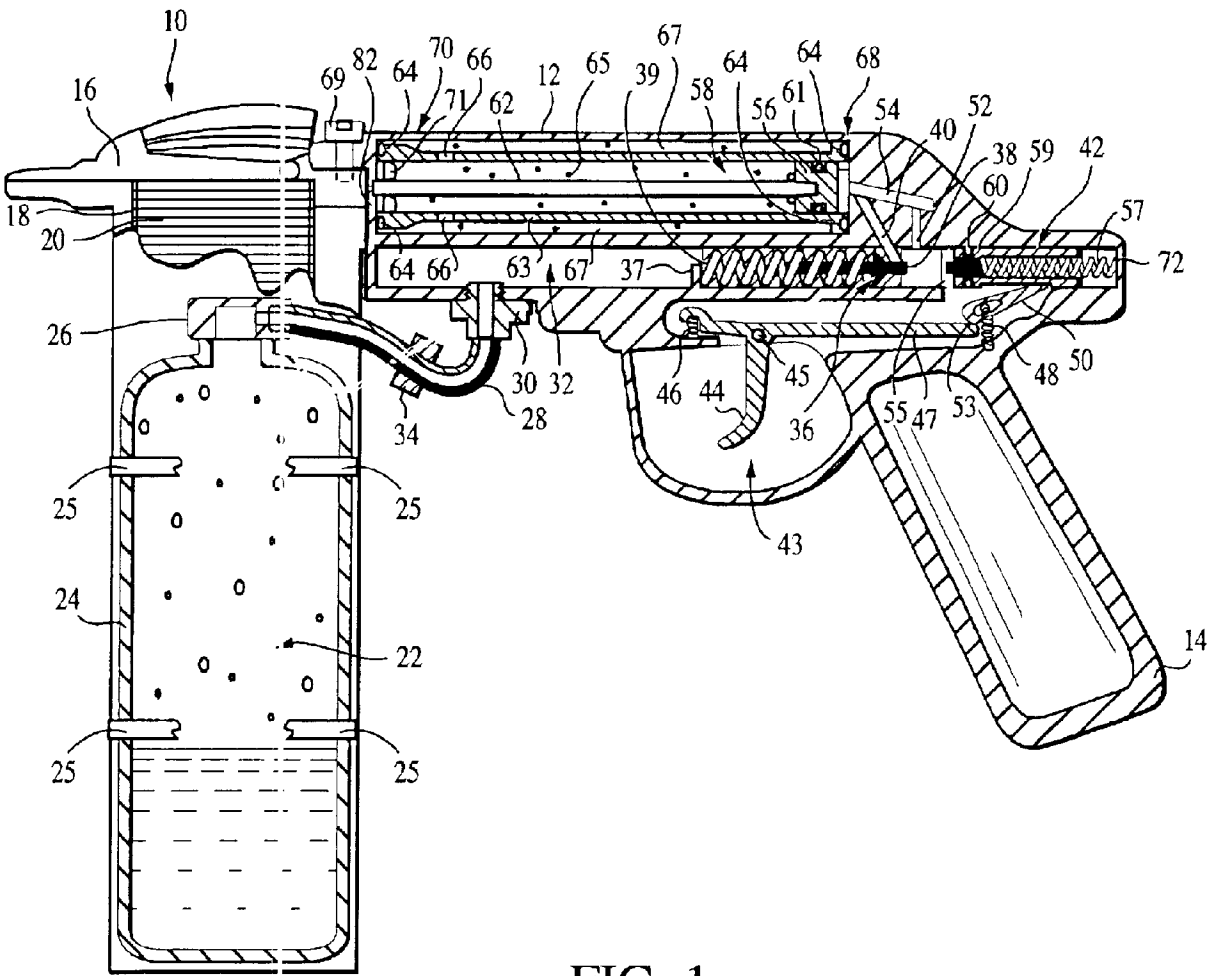
FIG. 1 is a vertical cross-section of a fastener tool of the type which is suitable for use with the present invention with portions partially shown for clarity.

As shown in FIGS. 1 through 4, a portable, pneumatically-powered fastener driving tool 10 constitutes one contemplated embodiment of this invention. More specifically, the fastener driving tool 10 includes a housing 12 having a handle 14 and a nosepiece assembly 16 which is mounted to the housing and which includes a fastener feed source or magazine 18. The nosepiece assembly 16 is configured for receiving one of a plurality of collated fasteners 20 sequentially fed to the nosepiece assembly by the fastener feed source 18. The fasteners 20 are subject to a biasing force which urges them toward the nosepiece assembly 16, where they are sequentially impacted by a reciprocating driver blade and driven into a workpiece (not shown) of wood or other material.

The pneumatically powered, fastener driving tool 10 can be operated with various self contained pre-pressurized power source medium 22, including, but not limited to, nitrous oxide ($N_2O$) or carbon dioxide ($C_2O$). The following description of a preferred embodiment utilizes self contained pre-pressurized $CO_2$ in a two phase mixture as the power source 22. An advantage of using a two phase mixture of $CO_2$ is that when the mixture is stored in a removable vessel 24 that is in equilibrium and has two phases of $CO_2$ remaining in the vessel, a constant pressure of the gas phase is maintained. That is, as gaseous $CO_2$ is removed from the vessel 24 to power the fastener driving tool 10, liquid $CO_2$ changes to a gas phase to replace lost gaseous $CO_2$ and maintain a constant pressure in the vessel. Another advantage of using a pressurized power source 22 such as $CO_2$ is that, due to the relatively high pressure of the gas (in the range of 800 psi), the number and size of the moving tool parts can be reduced. This reduces the likelihood of experiencing a mechanical failure, simplifies repairs, and lowers the overall manufacturing costs.

The pressurized $CO_2$ power source 22 is contained within the cartridge or vessel 24 which is removably attachable to the magazine 18 by suitable fasteners such as clips 25. One particular advantage of using removable vessels 24 of $CO_2$ is that such containers can be readily manufactured and made commercially available in various sizes of pressure vessels at different geographical locations. Moreover, such vessels 24 can be easily refilled, if desired. Another advantage of using a $CO_2$ mixture in pneumatic power tool applications is that $CO_2$ has certain desirable physical properties.

At room temperature, a filled vessel 24 of $CO_2$ exists under pressure at approximately 850 lbs/in$^2$ and consequently can be used as a pneumatic power source. Moreover, in this condition both liquid and gaseous $CO_2$ co-exist in the vessel 24 until released by a vessel valve 26. The vessel valve 26 can be a manually opening type valve, a screw-in type valve, which opens the valve as the vessel is installed, or any other type of gas pressure valve known in the art. Upon opening of the vessel valve 26 and exposing the $CO_2$ mixture 22 to ambient pressure, gaseous $CO_2$ will be released, and some of the liquid $CO_2$ will change phase to a gaseous state. If the vessel valve 26 is closed, equilibrium will be restored and the pressure within the vessel 24 will remain constant assuming no variations in temperature, which is another desirable property.

The process of convening the $CO_2$ mixture 22 can continue with subsequent openings and closings of the vessel valve 26 until all the liquid in the vessel 24 is consumed, at which time only $CO_2$ gas will remain in the vessel. Any further release of $CO_2$ from the vessel 24 will result in the pressure of the $CO_2$ gas in the vessel decreasing below the $CO_2$ mixture's initial pressure of approximately 850 lbs/in$^2$.

In the preferred embodiment, the fastener driving tool 10 is powered by the high-pressure $CO_2$ gas which exits the vessel 24 and is supplied via a high-pressure hose or line 28, having a nipple fitting 30, to a sealed chamber 32 in the housing 12. A pressure regulator 34 is optionally positioned along the line 28 for controlling the pressure of the $CO_2$ mixture 22 and is configured to lower the pressure to approximately 400 lbs/in$^2$.

In alternative embodiments, the regulator 34 can cause the $CO_2$ mixture 22 passed therethrough to be at pressures other than 400 lbs/in$^2$, which are less than the initial $CO_2$ mixture pressure of 850 lbs/in$^2$, as is known to those skilled in the art. Furthermore, the high-pressure hose 28 can be eliminated if the vessel 24 directly connects to the sealed chamber 32. However, an advantage of using the high-pressure hose is that the flexibility of the hose facilitates use of the tool 10 when it is operated in an upside down position. That is, the vessel 24 can be unclipped from the magazine 18 allowing the tool 10 to be used in an upside down position without the vessel also being turned upside down. Operating the tool 10 in this manner prevents the escape of liquid $CO_2$ from the vessel 24 and conserves the power source.

In yet another alternative embodiment, the tool 10 can be configured for operating directly with the $CO_2$ mixture 22 exiting the vessel 24. This type of configuration eliminates the need for a pressure regulator. Such a design, however, limits the effectiveness of the tool 10 after the $CO_2$ mixture 22 is purely in a gaseous state, since pressure within the vessel 24 is lowered as $CO_2$ gas escapes from the vessel.

Referring again to FIGS. 1 though 4, the sealed chamber 32 of the tool 10 contains a spring biased one-way valve 36, which is oriented to be normally-closed as best shown in FIG. 1. The one-way valve 36 includes a stop 37, a spring-biased reciprocating arm member 38, and a valve spring 39 that in the normally-closed position is biased to have the arm member 38 seal a first port 40. A spring-biased activating bolt or valve opening member 42 is initially in a set position as shown in FIG. 1, and is configured to contact the arm member 38 after being released by a trigger mechanism 43, which includes a trigger 44, a pivot pin 45, a trigger spring 46, a rear-facing arm 47, a sear spring 48, and a sear 50. To drive a fastener 20, a user squeezes the trigger 44, which activates the trigger mechanism 43 and causes a flow of $CO_2$ into the first port 40. The tool 10 also preferably has a second port 52 situated between the reciprocating arm member 38 and the activating bolt 42 which leads to a main chamber port 54 in fluid communication with the first port 40.

In the preferred embodiment, the activating bolt 42 is a reciprocating piston which is housed in a cylindrical cavity or bore 55 defined in the tool 10. In one embodiment, the bolt 42 is biased by a spring 57 located between the bolt and the housing 12. As shown in FIG. 1, the bolt 42 is located at the set position and is prevented from contacting the arm member 38 by the sear 50 of the trigger mechanism 43. The bolt 42 is released upon disengagement of the sear 50, which is accomplished by an operator pulling the trigger 44. In the depicted arrangement, the rear-facing arm 47 of the trigger 44 engages an adjacent end 53 of the sear 50.

Once the trigger 44 is pulled, the spring pressure acting on the bolt 42 is free to propel the bolt forward along its bore 55 generally toward the oneway valve 36 and specifically toward the arm member 38. At the end of the bore 55, the activating bolt 42 contacts the reciprocating arm member 38, opening the one-way valve 36 and allowing the high-pressure $CO_2$ mixture 22 to escape from the sealed chamber 32 through the ports 40 and 54 to a gas piston 56 positioned in a bore or main chamber 58. In an alternative embodiment, the reciprocating arm member 38 can be press fit into the cylindrical cavity 55.

The tool 10 also includes a piston 59 positioned in the cavity 55 and having a seal 60 such as an O-ring or the like that surrounds or encircles the piston and prevents $CO_2$ gas 22 from passing through the piston. Similarly, an O-ring or equivalent seal 61 encircles the gas piston 56 to prevent the flow of $CO_2$ gas 22 past the gas piston 56 and to the bore 58.

The high-pressure $CO_2$ gas 22 exerts a force on the gas piston 56 and drives the gas piston toward the nosepiece assembly 16. Attached to the piston 56 is a driver blade 62, which strips one fastener 20 from the magazine 18 and drives the fastener 20 into the workpiece. At the same time, a small portion of the high-pressure $CO_2$ gas 22 preferably acts against the activating bolt 42 to overcome the spring biasing force generated by the spring 57 and drive the activating bolt rearward to reset the trigger mechanism 43. That is, the recoil of the bolt 42 away from the one-way valve 36 uncovers the sear 50, which is biased by the sear spring 48 to capture the bolt at its set position. At this point, the piston 56 and the driver blade 62 have driven the fastener 20 into the workpiece.

A sleeve 63 surrounds the gas piston 56 and the driver blade 62 and is configured for aligning the piston 56 in the bore 58. Attached to the sleeve 63 at each end are seals 64 that prevent the escape of air 65 trapped in the bore 58 from escaping to the ambient environment. The sleeve 63 also includes ports 66 that permit the displacement of the air 65 to a return chamber 67 upon the high-pressure $CO_2$ gas 22 propelling the piston 56 towards the nosepiece assembly 16. The displaced air 65 in the return chamber 67 is under pressure, and returns the piston 56 toward a first end 68 of the bore 58.

The piston 56 and the driver blade 62 are configured to impact fasteners 20 sequentially fed into the nosepiece assembly 16 with each actuation of the trigger 44. To prevent motion of the nosepiece assembly 16 during reciprocation or the piston 56, a nosepiece assembly screw 69 fastens tile nosepiece assembly to the housing structure 12. Preferably, the piston 56 is smaller in diameter than a piston used in conjunction with the pressure regulator 34. However, another advantage of using the pressure regulator 34 is that the effect of lower ambient temperatures during tool operation, which cause a decrease in the vessel pressure, would be minimized and provide for a more consistent power output for the tool 10 over a broad temperature range. Moreover, in high ambient temperature conditions, the vessel 24 of the tool 10 can be equipped with a pressure relief valve (not shown) that can direct the flow of any released gas 22 towards the vessel to provide cooling and further broaden the temperature range.

Referring now to FIG. 1, the piston 56 is shown fully retracted to the main chamber port 54 in a pre-firing or set position at the first end 68 of the bore 58. When the one-way valve 36 is opened, the ports 42, 52, and 54 direct the flow of pressurized medium 22 passing through the one-way valve 36 such that the piston 56 is propelled to a fired position or a second end 70 of the bore 58. An annular bumper 71 prevents further motion of the piston 56 toward the nosepiece assembly 16. The housing 12 also includes a housing port 72 for permitting $CO_2$ to escape to the ambient environment upon actuation of the trigger mechanism.

In operation, the tool 10 is initially in an unfired position with the trigger 44 not actuated as shown in FIG. 1. The one-way valve 36 is closed, and the sear 50 prevents movement of the activating bolt 42 towards the one-way valve. The $CO_2$ mixture 22 is contained in the vessel 24 and the sealed chamber 32. Further, the piston 56 is positioned at the first end 68 of the bore 58 so as to maximize the distance traveled by the driver blade 62 prior to impact with a fastener 20.

Figure 2:
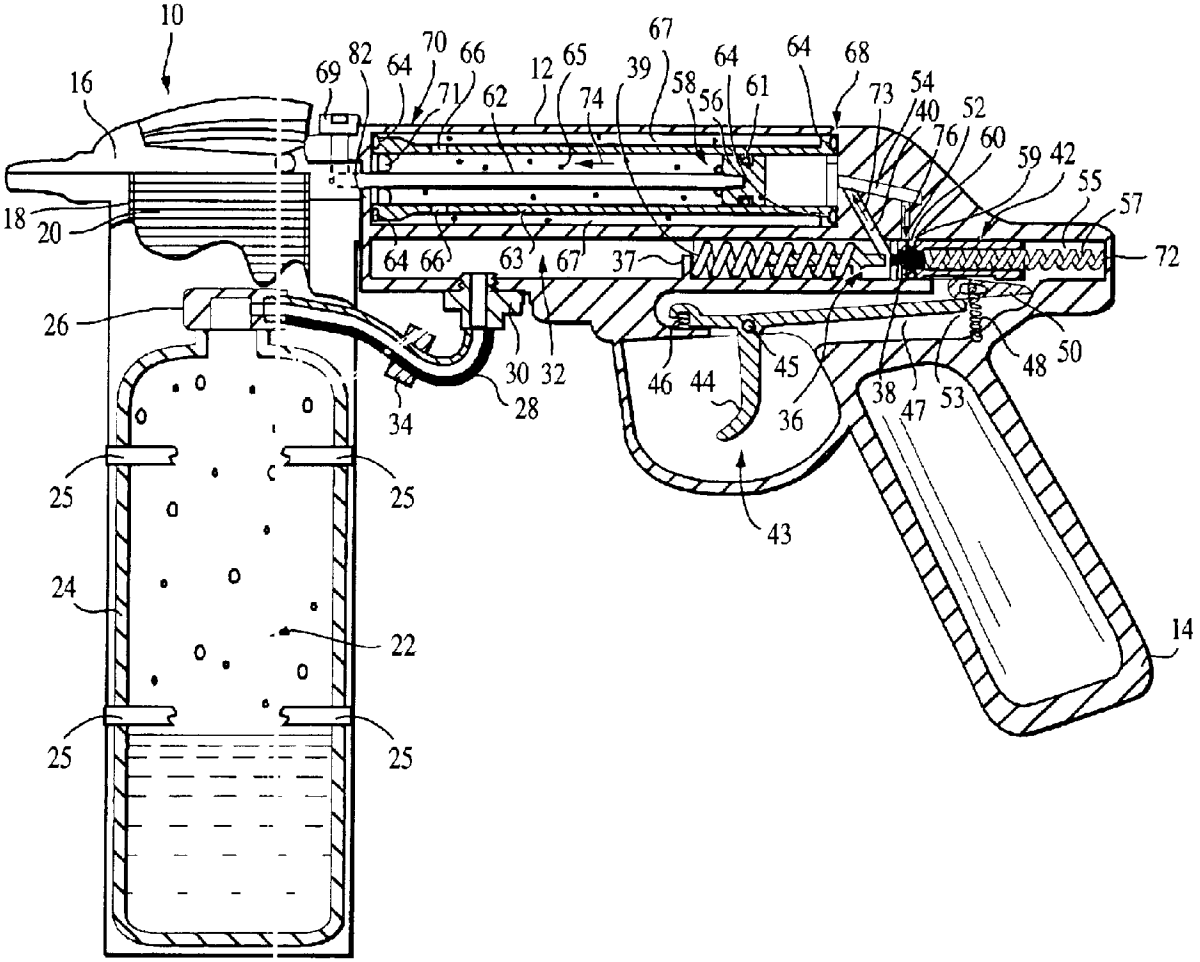
FIG. 2 is a vertical cross-section of the tool shown in FIG. 1 with the trigger mechanism actuated.

Referring now to FIG. 2, upon activation of the trigger 44, the sear 50 pivots, releasing the bolt 42 which opens the valve 36. Pressurized $CO_2$ gas 22 passes from the sealed chamber 32 into the first port 40 in the direction of an arrow 73 and then into the main chamber port 54. The passage of $CO_2$ gas 22 into the main chamber port 54 propels the piston 56 in the direction of an arrow 74 toward the nosepiece assembly 16. The $CO_2$ gas 22 additionally flows through the second port 52 in the direction of an arrow 76 and escapes from the housing 12 via the housing port 72.

Figure 3:
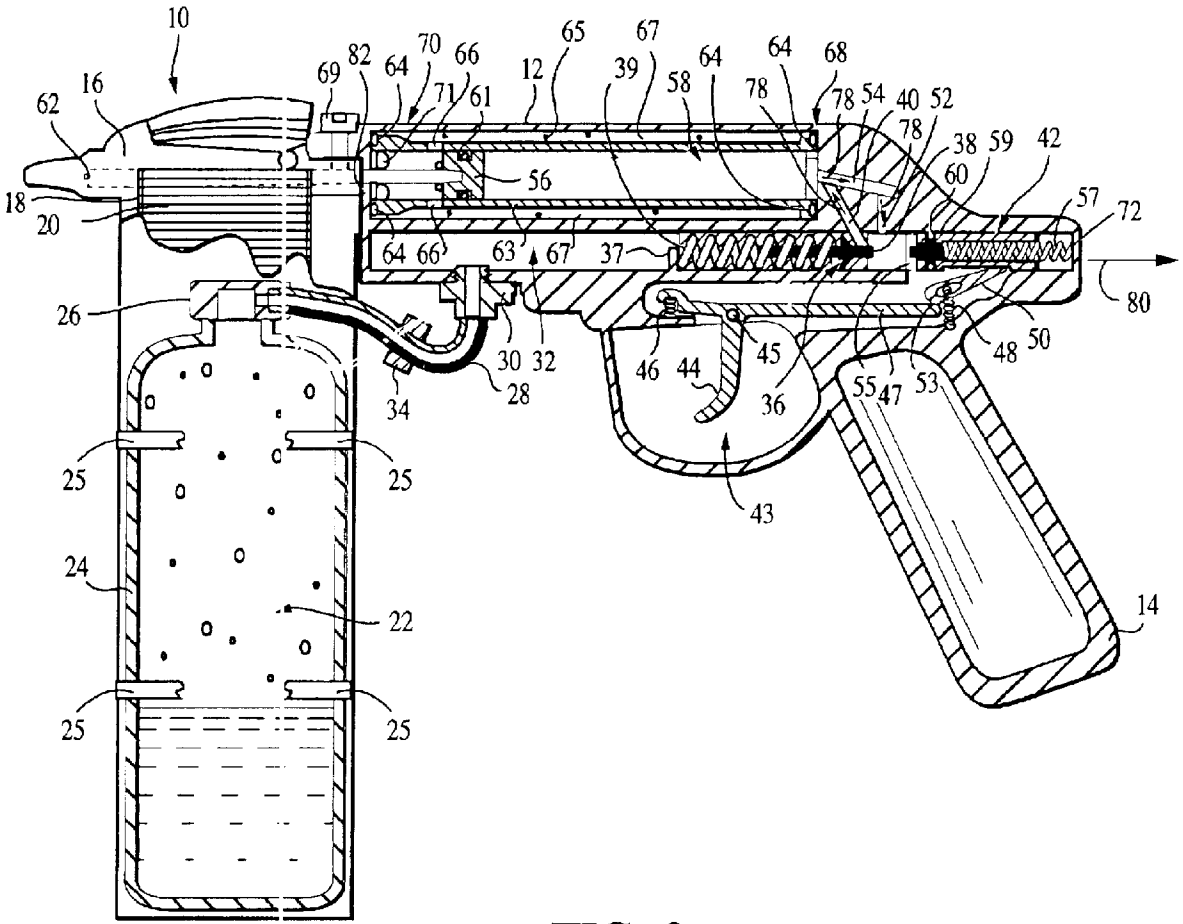
FIG. 3 is a vertical cross-section of the tool shown in FIG. 1 with the piston in a driving stroke.

FIG. 3 shows the position of the gas piston 56 just prior to reaching the bumper 71. The flow of $CO_2$ gas 22 is now in the direction shown by arrows 78, and $CO_2$ striking the activating bolt 42 causes it to recoil in the direction of an arrow 80 toward its set position. The displacement of the piston 56 creates a positive air pressure below the piston 56 at an air pocket 82. During the rearward movement of the activating bolt 42, the ports 52, 54, and 72 above the piston 56 are open to the atmosphere, at which time the $CO_2$ gas 22 in the bore 58 escapes from the port 72. Quickly thereafter, the air pressure at the air pocket 82 exceeds the pressure above the piston 56 in the ports 52 and 54, and the piston 56 is returned to its set position at the first end 68.

Figure 4:
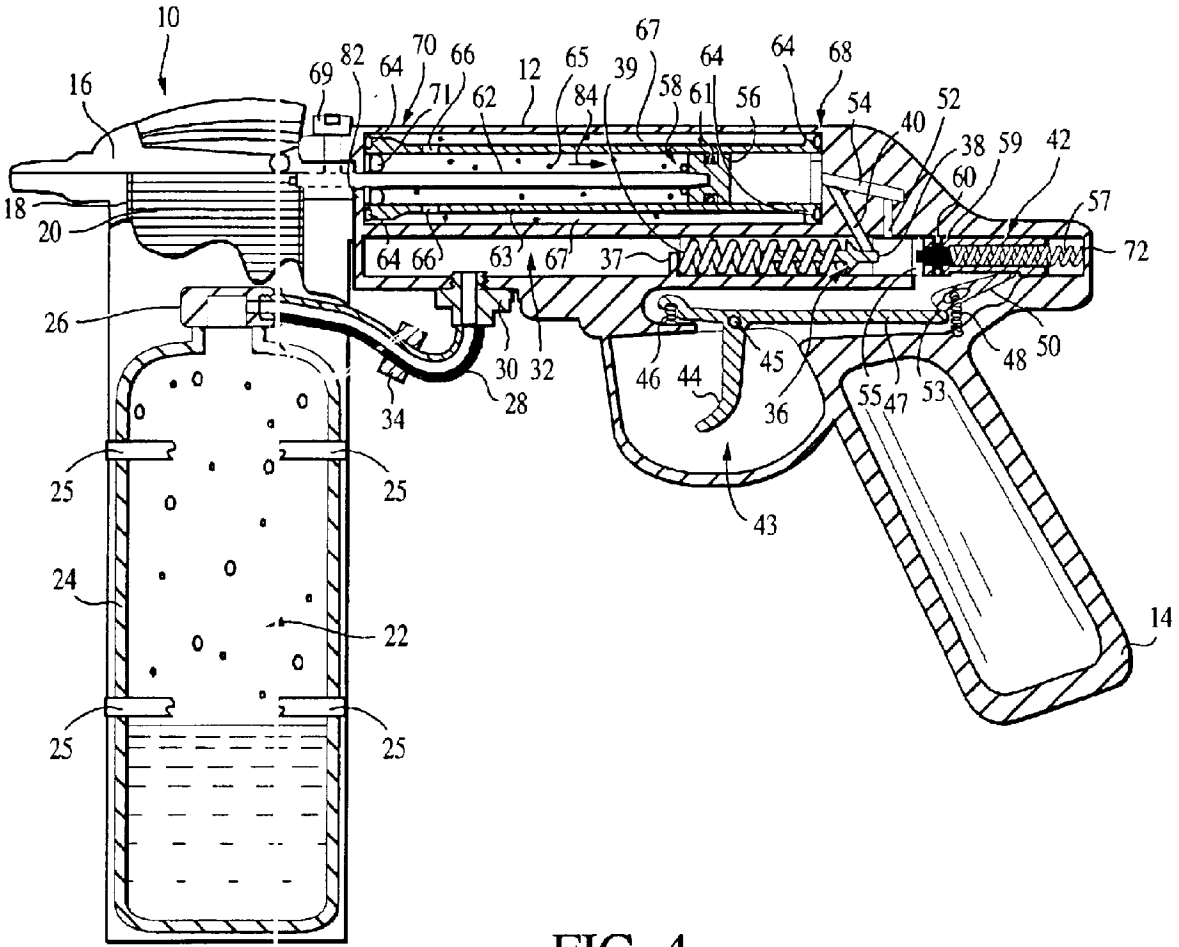
FIG. 4 is a vertical cross-section of the tool shown in FIG. 1 with the piston in a return stroke.

Referring now to FIG. 4, the return stroke of the piston 56 is illustrated. The activating bolt 42 is returned to its set position, which closes the one-way valve 36 and prevents the escape of $CO_2$ from the housing port 72. The piston 56 retracts toward the first end 68 of the bore 58 in the direction of an arrow 84. Upon the piston 56 reaching the first end 68, the tool 10 is again set up in a pre-firing mode and can be used to drive another fastener 20 by actuation of the trigger 44.

While a particular embodiment of the fastener driving tool of the present invention has been disclosed, it will be appreciated by those skilled in the art that changes and modifications may be made thereto without departing from the invention in its broader aspects and as set forth in the following claims.

What is claimed is:

1. A portable pneumatic power tool having a fastener feed source to supply collated fasteners to a nose piece assembly end of the tool for impacting into a workpiece, comprising:

a housing having a cavity with a housing port adjacent one end;

a self contained pre-pressurized power delivery source; and a reciprocating driver blade at least partially positioned within the housing and driven by the self-contained pre-pressurized power delivery source; and a trigger mechanism connected to said housing and including a valve configured for enabling at least a portion of the delivery source to power said driver blade;

wherein said valve is configured for being actuated by a valve opening member upon actuation of said trigger mechanism, said valve opening member having a piston reciprocal in said cavity and a seal encircling at least a portion of said piston, said valve opening member configured for preventing unwanted flow of at least a portion of the delivery source toward said housing port in said cavity upon an actuation of said trigger mechanism.

2. The tool of claim 1 further comprising a sealed chamber within the housing, and said valve is configured for controlling a flow of the self contained pre-pressurized power delivery source from said sealed chamber.

3. The tool of claim 2 wherein said valve is a one-way valve configured for passing the self contained pre-pressurized power delivery source from said sealed chamber to the driver blade.

4. The tool of claim 2 further comprising a pressure vessel connectable to said sealed chamber and configured for feeding the self contained pre-pressurized power delivery source to said housing.

5. The tool of claim 4 wherein the pressure vessel is detachable from said housing.

6. The tool of claim 4 comprising a flexible hose configured for feeding the self contained pre-pressurized power delivery source to the sealed chamber.

7. The tool of claim 1 wherein said trigger mechanism further comprises a trigger, and said valve opening member is an activating bolt configured for opening the valve upon actuation of said trigger.

8. The tool of claim 7, further including a sear configured for engaging with the trigger to prevent movement of the activating bolt.

9. The tool of claim 1 wherein said housing is configured for permitting the self contained pre-pressurized power delivery source to escape to an ambient from the housing.

10. The tool of claim 1 further comprising a return chamber configured for receiving air displaced by said driver blade upon actuation of the trigger mechanism to drive the driver blade.

11. A trigger mechanism for a fastener driving tool having a self contained pre-pressurized power source and a magazine for storing and sequentially urging fasteners toward a nosepiece assembly through which a driver blade travels to impact and drive the fasteners into a workpiece, the trigger mechanism comprising:

a valve-opening member including a piston reciprocal in a cavity and a seal encircling at least a portion of said piston;

a trigger configured to hold said valve opening member in a set position until actuation of said trigger; and a valve configured for being opened and closed by reciprocation of said valve opening member, wherein said valve controls a flow of a pressurized medium from the self contained pre-pressurized power source;

wherein said seal prevents the flow of the pressurized medium from passing through said bore upon actuation of said trigger mechanism for powering said driver blade.

12. The trigger mechanism of claim 11 further comprising a sear engageable by said trigger for locking the valve-opening member in the set position.

13. The trigger mechanism of claim 12 further comprising a sear spring configured for biasing said sear to engage the valve-opening member.

14. The trigger mechanism of claim 11 wherein the valve-opening member is spring-biased.

15. The trigger mechanism of claim 11 wherein said valve includes a spring-biased arm member.

16. The trigger mechanism of claim 11 wherein said seal comprises: an O-ring.

17. A portable pneumatic power tool having a fastener feed source to supply collated fasteners to a nose piece assembly end of the tool for impacting into a workpiece, comprising:

a housing having a sealed chamber sealed by a valve and configured for receiving a self contained pre-pressurized power delivery source filling said sealed chamber;

a reciprocating driver blade at least partially positioned within the housing and driven by the delivery source upon an opening of said valve; and a trigger mechanism connected to said housing configured for preventing the passage of said at least a portion of said source from said sealed chamber prior to actuation of said trigger mechanism and powering said driver blade;

wherein said valve is opened by actuation of a valve opening member upon actuation of said trigger mechanism.

* * * * *